US005574334A

United States Patent [19]

Robol

[11] Patent Number: 5,574,334

[45] Date of Patent: Nov. 12, 1996

[54] SUBMERGED LAMP WITH SELF GROUNDING SLEEVE

[75] Inventor: Ronald B. Robol, Sanford, N.C.

[73] Assignee: Essef Corporation, Chardon, Ohio

[21] Appl. No.: 402,911

[22] Filed: Mar. 13, 1995

[51] Int. Cl.[6] ..... H01J 17/00; H01J 61/00; F21V 33/00; F21V 29/00

[52] U.S. Cl. ..... 313/578; 313/590; 362/101; 362/267

[58] Field of Search ..... 313/331, 332, 313/333, 578, 590, 605, 626; 315/74, 75, 119, 125; 362/101, 267

[56] References Cited

U.S. PATENT DOCUMENTS 1,901,703 4/1931 Crowley .

4,544,996 10/1985 George .

OTHER PUBLICATIONS

U.S. application Serial No. 08/119,617, filed Sep. 13, 1993, for "Self Grounding Lamp".

*Primary Examiner*—Michael Tokar
*Assistant Examiner*—Mack Haynes
*Attorney, Agent, or Firm*—Pearne, Gordon, McCoy & Granger

[57] ABSTRACT

A conductive sleeve is located around each of the filament supports of an incandescent lamp enclosed in a glass bulb. The sleeve is spaced from the support by an insulating spacer. The sleeve is connected to a ground so that if the bulb breaks liquid flowing into the bulb creates a conducting path between the filament supports and the ground. The sleeve has a generally hollow, cylindrical shape spaced and is positioned around the support.

18 Claims, 2 Drawing Sheets

SUBMERGED LAMP WITH SELF GROUNDING SLEEVE

BACKGROUND OF THE INVENTION

1. Field of the Invention

This invention relates generally to the field of lamps and specifically to a submerged lamp with a self grounding sleeve.

2. Description of the Related Art

Electric lighting installations are commonly located below water level in swimming pools, spas, hot tubs and other liquid containing apparatus. The lighting installation generally includes a lamp disposed in a sealed enclosure to isolate the lamp from the water. The enclosure includes a lens used to focus, diffuse, or color the light. If the lens breaks or the enclosure leaks significantly, water flowing into the enclosure will usually cause the glass bulb of the lamp to break. The water then creates a conducting path from the lamp's electrical power source into the pool, thus permitting a current to flow through the water.

Electrical components and accessories for a pool are usually connected to a grounding grid or another common circuit to minimize the likelihood of a current traveling through the pool. Lighting installations are equipped with various means of ensuring that a fault will travel to ground instead of through the pool. U.S. Patent application Ser. No. 08,119,617, filed Sep. 13, 1993, shows a mechanical spring device for connecting filament supports to ground if the filament breaks. U.S. Pat. No. 4,544,996 to George shows a lamp with a ground conductor disposed between two filament supports.

In such installations, it is desirable to maximize the likelihood that a current will travel to ground rather than through the pool. It is an object of the present invention to provide a lamp that minimizes the likelihood of creating a current through a pool upon breakage of the lamp.

SUMMARY OF THE INVENTION

The present invention provides a lamp having a sealed enclosure and a filament disposed in the enclosure. A pair of electrical conductors disposed in the enclosure are connected to the filament and adapted to be connected to an electrical power source external to the enclosure. An electrically conductive sheet disposed in the enclosure adjacent one of the conductors is spaced from the conductors and adapted to be connected to a ground external to the enclosure.

Preferably the enclosure is breakable glass and is watertight. The conductors are filament supports. A pair of power contacts are connected to respective filament supports and adapted to be connected to the electrical power source. A grounding contact is connected to the sheet and adapted to be connected to the ground. The sheet is a sleeve around the conductor. The sheet can be perforated. The sheet is generally cylindrical and an insulating spacer is disposed between the sheet and the conductor. The spacer is shaped to permit passage of liquid between the sheet and the conductor. The sheet is made of stainless steel. The enclosure includes a base to which the filament, conductors, and sheet are mounted and adapted to be received in a socket.

A second sheet is disposed in the enclosure adjacent the other of the conductors. The second sheet is spaced from the conductors and adapted to be connected to a ground external to the enclosure. A conductive strap electrically connects the two sheets.

The invention also comprehends a lighting system for submerged installation. A pair of electrical power conductors are connected to an electrical power source. An electrical ground conductor is connected to ground. A lamp, as described above, has the electrical conductors connected to respective power conductors. The electrically conductive sheet is connected to the ground conductor.

DESCRIPTION OF THE PREFERRED EMBODIMENTS

Figure 1:
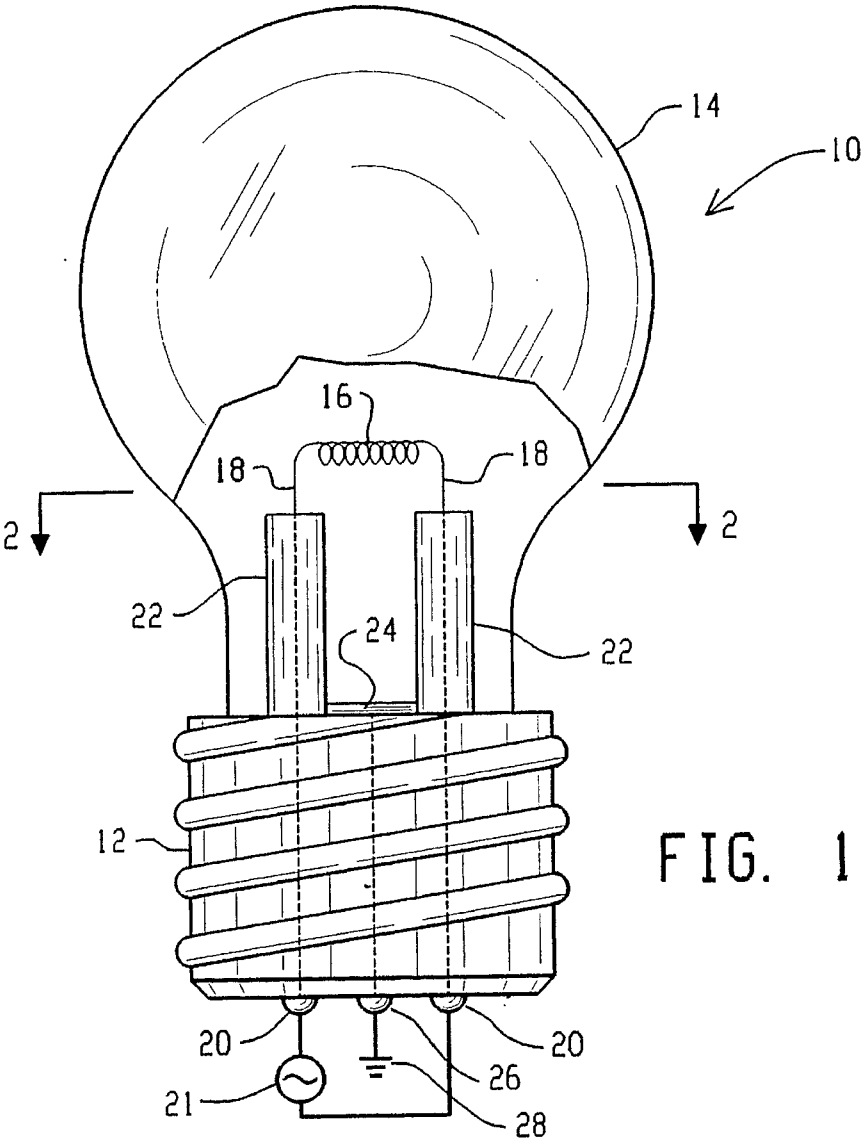
FIG. 1 shows an elevation of a lamp according to the invention.

Referring to FIG. 1, an electric lamp 10 includes a base 12 and a bulb 14 defining a sealed enclosure. The base 12 is threaded or otherwise adapted for mounting in a suitable receptacle or socket. The bulb 14 is preferably made of transparent or translucent glass. A filament 16 is supported in the bulb 14 by a pair of conductors, such as filament supports 18. The filament supports extend into the base 12 and are electrically connected to respective power contacts 20. The power contacts 20 are adapted to be connected to an electrical power source 21, such as hot and neutral leads of a household electrical system.

A conductive sleeve 22 is disposed around each of the filament supports 18. The sleeves 22 are electrically interconnected by a conductive strap 24. The strap 24 is connected to a grounding contact 26 adapted to be connected to a ground 28, such as a grounding grid under a swimming pool or an earth ground.

Figure 2:
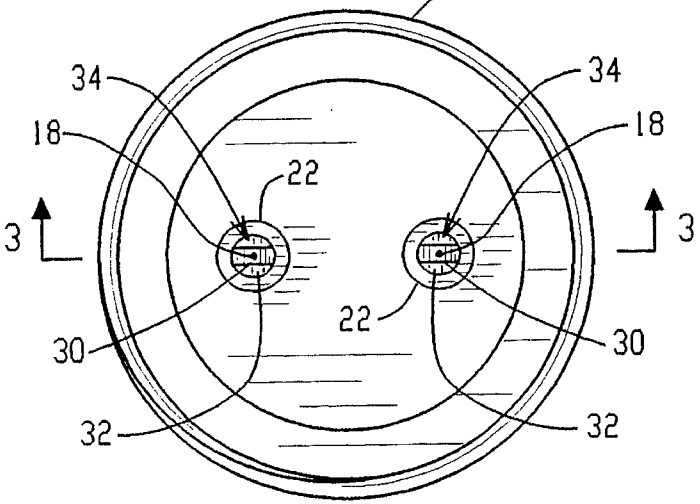
FIG. 2 shows a top view of the lamp in a section taken from line 2—2 of FIG. 1.
Figure 3:
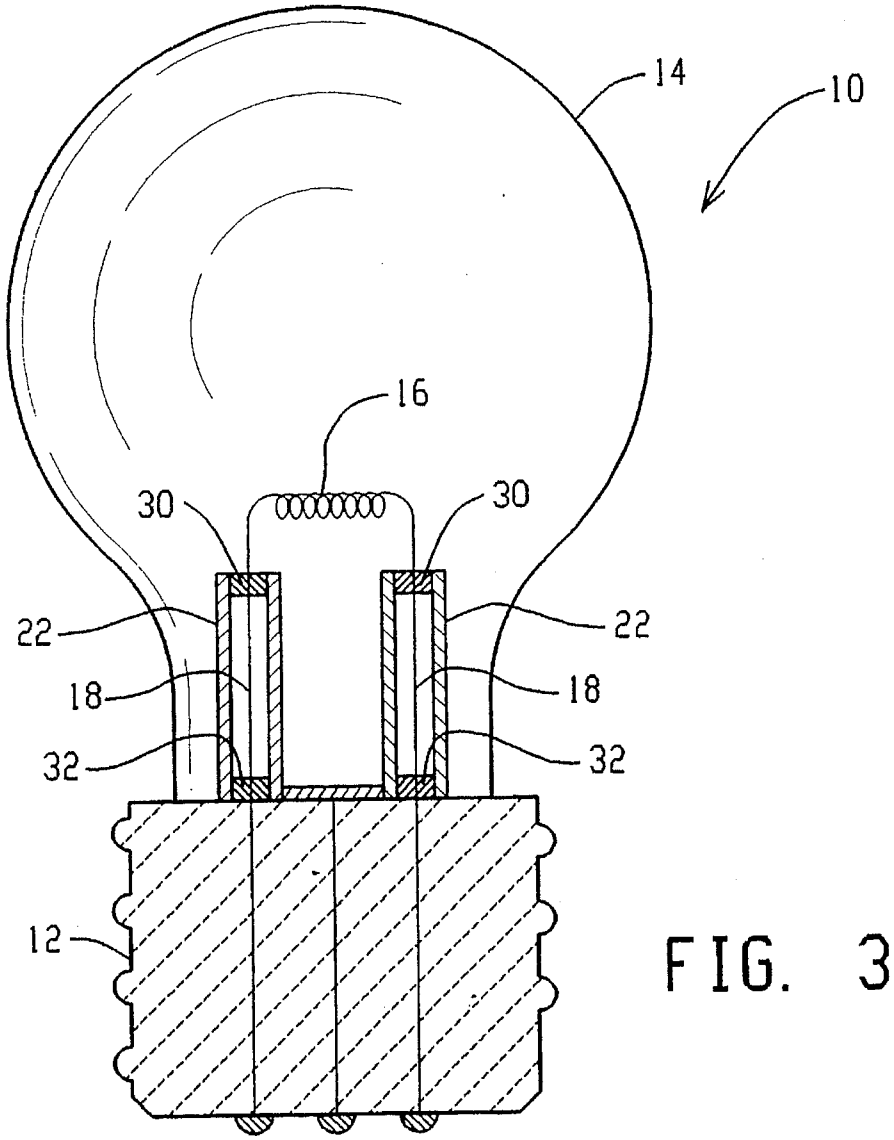
FIG. 3 shows an elevation of the lamp taken in section from line 3—3 of FIG. 2.

Referring to FIGS. 2 and 3, the sleeves 22 are made from sheets of conductive and corrosion resistant material, such as 304 stainless steel, formed into a hollow, generally cylindrical shape. The filament supports 18 extend through the sleeves 22 along a longitudinal axis thereof. The sleeves 22 are spaced from the filament supports 18 by upper insulating spacers 30 and lower insulating spacers 32. The spacers 30, 32 are made of an electrically insulating material. The lower spacer 32 is generally cylindrical and have an outside diameter approximately equal to the inside diameter of the sleeve 22. The filament support 18 passes through the center of the upper and lower spacers 30, 32. The upper spacer 30 is generally rectangular with curved ends and spans the inside diameter of the sleeve 22 thereby defining a gap 34 between the spacer 30 and the sleeve 22. Other suitable shapes for the upper spacer 30 will be apparent to one skilled in the art, and examples are shown in U.S. Pat. No. 1,901,703 to Crowley. The gap 34 permits the passage of liquid therethrough, as discussed below. The filament support 18 and sleeve 22 should be spaced to prevent arcing during normal operation. The distance from the filament support 18 to the sleeve 22 should be less than ½" for a 120 VAC supply and water with a resistivity of 300 Ω. Other configurations are suitable for different conditions and materials.

Figure 4:
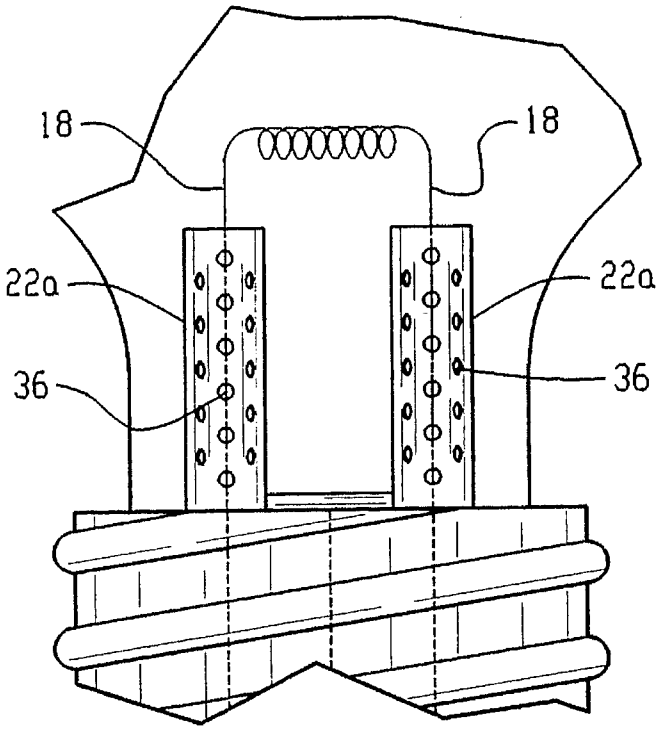
FIG. 4 shows a detailed elevation of another aspect of the invention.

Referring to FIG. 4, the sheet material of the sleeves 22*a* can be provided with perforations 36 therethrough. The perforations can be of any suitable number and shape to permit passage of liquid therethrough in addition to or in lieu of the gaps 34.

The lamp 10 is installed in a fixture submerged in or close to a swimming pool or other liquid container. Generally, a lens and walls of the fixture separate the lamp from the liquid. In operation, an electrical current through the filament supports 18 and filament 16 causes the filament to glow. If the lens breaks or liquid otherwise leaks into the fixture, the liquid will frequently cause the bulb 14 to shatter and the filament 16 to break. The liquid then flows into the sealed enclosure. The liquid flows through the gaps 34 and/or perforations 36 to substantially fill the space between each sleeve 22 and filament support 18. The liquid in the space provides a conducting path between the filament supports 22 and the ground 28, thereby reducing the likelihood that a current will flow from the filament supports 22 through the liquid in the pool or container.

The present disclosure describes several aspects of the invention, however, the invention is not limited to these aspects. Other variations are contemplated to be within the spirit and scope of the invention and appended claims.

What is claimed is:

1. A lamp comprising:

a sealed enclosure;

a filament disposed in the enclosure;

a pair of electrical conductors disposed in the enclosure, connected to the filament, and adapted to be connected to an electrical power source external to the enclosure; and an electrically conductive sheet disposed in the enclosure adjacent one of the conductors, wherein the sheet comprises a sleeve around the one conductor, spaced from the conductors, and adapted to be connected to a ground external to the enclosure.

2. A lamp according to claim 1, wherein the enclosure is breakable.

3. A lamp according to claim 1, wherein the enclosure comprises glass.

4. A lamp according to claim 1, wherein the enclosure is watertight.

5. A lamp according to claim 1, wherein the conductors comprise filament supports.

6. A lamp according to claim 5, further comprising:

a pair of power contacts connected to respective filament supports and adapted to be connected to the electrical power source; and a grounding contact connected to the sheet and adapted to be connected to the ground.

7. A lamp according to claim 6, wherein the sheet is perforated.

8. A lamp according to claim 6, wherein the sheet is generally cylindrical.

9. A lamp according to claim 8, further comprising an insulating spacer disposed between the sheet and the one conductor.

10. A lamp according to claim 9, wherein the spacer is shaped to permit passage of liquid between the sheet and the one conductor.

11. A lamp according to claim 1, wherein the sheet comprises stainless steel.

12. A lamp according to claim 1, further comprising an insulating spacer disposed between the sheet and the one conductor.

13. A lamp according to claim 1, further comprising a second sheet disposed in the enclosure adjacent the other of the conductors, spaced from the conductors, and adapted to be connected to a ground external to the enclosure.

14. A lamp according to claim 13, further comprising a conductive strap electrically connecting the two sheets.

15. A lamp according to claim 1, wherein the enclosure includes a base to which the filament, conductors, and sheet are mounted and adapted to be received in a socket.

16. A lamp for submerged installation comprising:

a base;

a filament;

a pair of electrically conductive filament supports mounted on the base and connected to and supporting respective ends of the filament;

a pair of power contacts mounted on the base and connected to respective filament supports and adapted to be connected to an electrical power source;

a pair of electrically conductive sleeves mounted on the base and around respective filament supports and spaced therefrom;

a grounding contact mounted on the base and connected to the sleeves and adapted to be connected to a ground;

insulating spacers disposed between the sleeves and the filament supports;

a breakable glass bulb mounted on the base and forming therewith a sealed enclosure enclosing the filament, supports, and sleeve.

17. A lamp according to claim 16, wherein the sleeves are hollow and generally cylindrical.

18. A lighting system for submerged installation comprising:

a pair of electrical power conductors connected to an electrical power source;

an electrical ground conductor connected to ground; and a lamp for submerged installation, said lamp comprising:

a sealed enclosure;

a filament disposed in the enclosure;

a pair of electrical conductors disposed in the enclosure, connected to the filament, and connected to respective power conductors; and an electrically conductive sheet disposed in the enclosure adjacent one of the conductors, wherein the sheet comprises a sleeve around the one conductor, spaced from the conductors, and connected to the ground conductor.

* * * * *